US008991551B2

(12) United States Patent
Latka

(10) Patent No.: US 8,991,551 B2
(45) Date of Patent: Mar. 31, 2015

(54) WEAPON SILENCERS AND BAFFLES FOR WEAPON SILENCERS

(71) Applicant: Gregory S. Latka, Jackson, MI (US)

(72) Inventor: Gregory S. Latka, Jackson, MI (US)

(73) Assignees: GSL Technology, Inc., Jackson, MI (US); Gemtech, Boise, ID (US)

( * ) Notice: Subject to any disclaimer, the term of this patent is extended or adjusted under 35 U.S.C. 154(b) by 0 days.

(21) Appl. No.: 14/146,787

(22) Filed: Jan. 3, 2014

(65) Prior Publication Data

US 2014/0224574 A1 Aug. 14, 2014

Related U.S. Application Data

(60) Provisional application No. 61/748,463, filed on Jan. 3, 2013.

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 1,111,202 | A * | 9/1914 | Westfall | 89/14.4 |
| 1,259,251 | A * | 3/1918 | Love | 181/223 |
| 1,605,864 | A | 11/1926 | Steinegger | |
| 3,500,955 | A | 3/1970 | Werbell | |
| 3,667,570 | A * | 6/1972 | WerBell, III | 181/223 |
| 4,588,043 | A * | 5/1986 | Finn | 181/223 |
| 5,029,512 | A | 7/1991 | Latka | |
| 5,559,302 | A | 9/1996 | Latka | |
| 5,685,102 | A | 11/1997 | Latka | |
| 6,302,009 | B1 | 10/2001 | O'Quinn et al. | |
| 6,308,609 | B1 | 10/2001 | Davies | |
| 6,425,310 | B1 | 7/2002 | Champion | |
| 6,575,074 | B1 | 6/2003 | Gaddini | |
| 7,237,467 | B1 | 7/2007 | Melton | |
| 7,308,967 | B1 | 12/2007 | Hoel | |
| 7,789,008 | B2 | 9/2010 | Petersen | |
| 8,087,338 | B1 * | 1/2012 | Hines | 89/14.4 |
| 8,100,224 | B1 | 1/2012 | Olson | |
| 8,210,087 | B2 | 7/2012 | Latka | |
| 2011/0297477 | A1 | 12/2011 | Koumbis | |
| 2012/0272818 | A1 * | 11/2012 | Dueck et al. | 89/14.4 |

OTHER PUBLICATIONS

Written Opinion of the International Searching Authority, International Application No. PCT/US14/10163, Sep. 9, 2014.

* cited by examiner

*Primary Examiner* — Jeremy Luks
(74) *Attorney, Agent, or Firm* — Young Basile Hanlon & MacFarlane P.C.

(57) ABSTRACT

A baffle for a weapon silencer includes an annular wall that defines an axial passageway. The annular wall defines a first section located adjacent to a first axial end and in which the diameter of the axial passageway increases from a smallest diameter adjacent to the first axial end to a largest diameter. The annular wall defines a second section having a spiraled vane is formed on an exterior surface of the annular wall. The annular wall defines a third section that is located adjacent to the second axial end, the third section having a plurality of ports that extend radially through the annular wall to allow communication between the axial passageway and an exterior.

20 Claims, 5 Drawing Sheets

WEAPON SILENCERS AND BAFFLES FOR WEAPON SILENCERS

CROSS-REFERENCE TO RELATED APPLICATIONS

This application claims the benefit of U.S. Provisional Patent Application Ser. No. 61/748,463, which was filed on Jan. 3, 2013.

STATEMENT REGARDING FEDERALLY SPONSORED RESEARCH OR DEVELOPMENT

Not applicable.

TECHNICAL FIELD

The disclosure herein relates to weapon silencers and baffles for weapon silencers.

BACKGROUND

Firearm muzzle silencers absorb and reduce the audible frequencies and vibrations occurring from the rapid expansion of gases leaving a firearm muzzle as the projectile leaves the gun bore. Such devices, in addition to reducing audible frequencies, also contain and arrest muzzle flash. Silencers, conventionally, are designed to temporarily contain and divert the expanding gases, and necessarily, effective firearm silencers are typically relatively large and bulky so that they can accommodate the large volume of expanding gas, especially with higher caliber firearms.

Firearm silencers or suppressors are known wherein a plurality of baffles is mounted within the silencer body in axially aligned relationship wherein the baffles include conical or expanding volume bores. It is also known to employ spiral baffles or vanes in firearm silencers for increasing the gas path of movement length and arresting gas expansion. Some silencers incorporate baffles having diverging bores and spiral vanes located on the exterior surface of baffles.

SUMMARY

One aspect of the disclosed embodiments is a baffle for a weapon silencer that includes an annular wall that defines an axial passageway that extends from a first axial opening at a first axial end to a second axial opening at a second axial end. The annular wall defines a first section located adjacent to the first axial end and in which the diameter of the axial passageway increases from a smallest diameter adjacent to the first axial end to a largest diameter adjacent at a location that is spaced from the first axial end. The annular wall defines a second section having a spiraled vane formed on an exterior surface of the annular wall. The annular wall defines a third section that is located adjacent to the second axial end, the third section having a plurality of ports that extend radially through the annular wall to allow communication between the axial passageway and an exterior.

Another aspect of the disclosed embodiments is a weapon silencer that includes a cylindrical housing that extends from a first end to a second end, a mounting structure connected to the first end of the cylindrical housing, wherein the mounting structure is configured to connect the cylindrical housing to a weapon, a cap connected to the second end of the cylindrical housing, and a plurality of axially adjacent annular baffles. The baffles are disposed within the cylindrical housing, each baffle having an annular wall that defines an axial passageway that extends from a first axial opening at a first axial end of the baffle to a second axial opening at a second axial end of the axial baffle. The annular wall defines a first section located adjacent to the first axial end of the baffle in which the diameter of the axial passageway increases from a smallest diameter adjacent to the first axial end of the baffle to a largest diameter adjacent at a location that is spaced from the first axial end of the baffle. The annular wall defines a second section having a spiraled vane formed on an exterior surface of the annular wall of the baffle. The annular wall defining a third section that is located adjacent to the second axial end of the baffle, the third section having a plurality of ports that extend radially through the annular wall of the baffle to allow communication between the axial passageway and an exterior of the baffle.

BRIEF DESCRIPTION OF THE DRAWINGS

The disclosure herein will be made with reference to the drawings in which.

DETAILED DESCRIPTION

Figure 1:
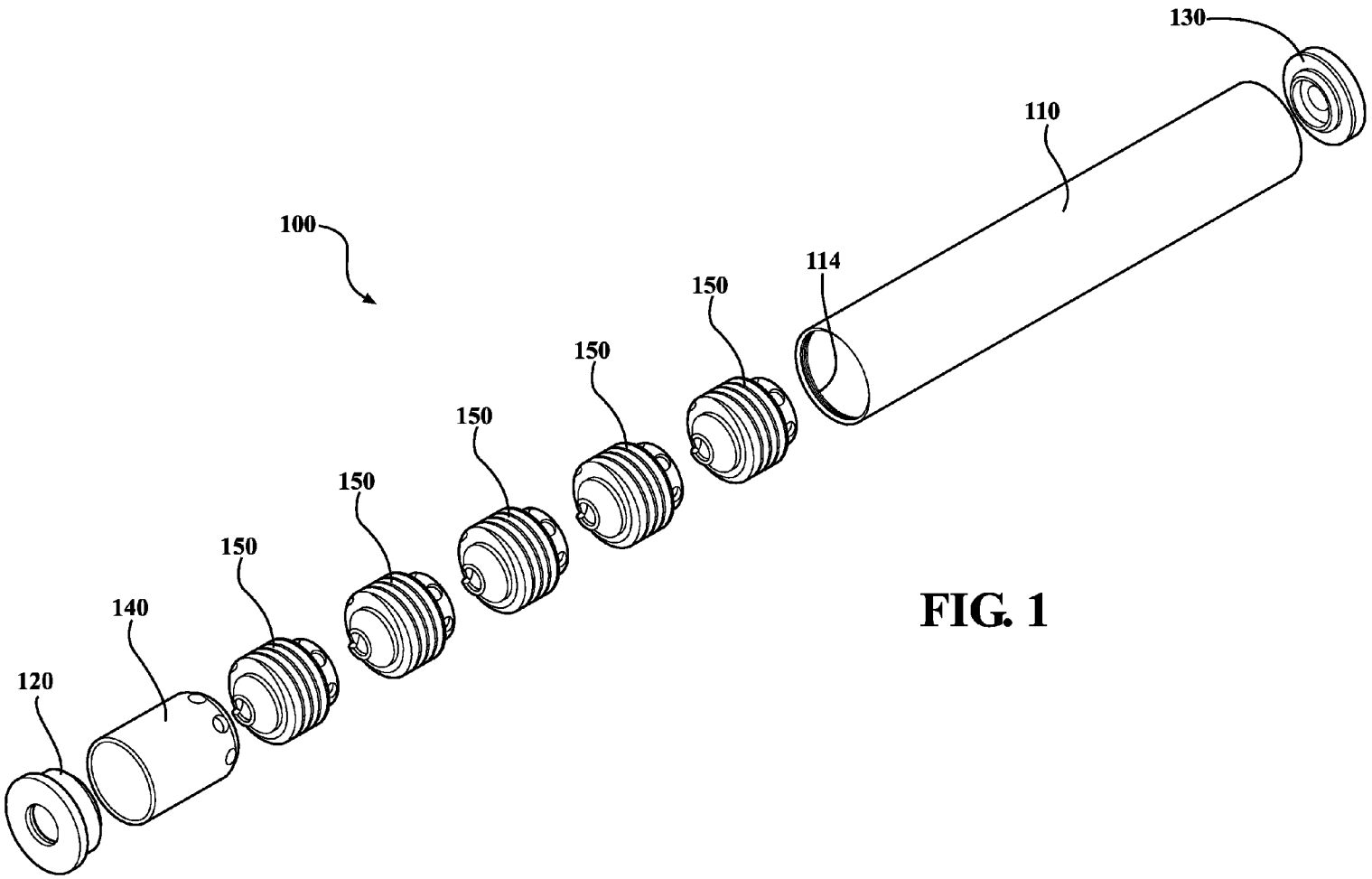
FIG. 1 is an exploded perspective view showing a weapon silencer according to a first example.
Figure 2:
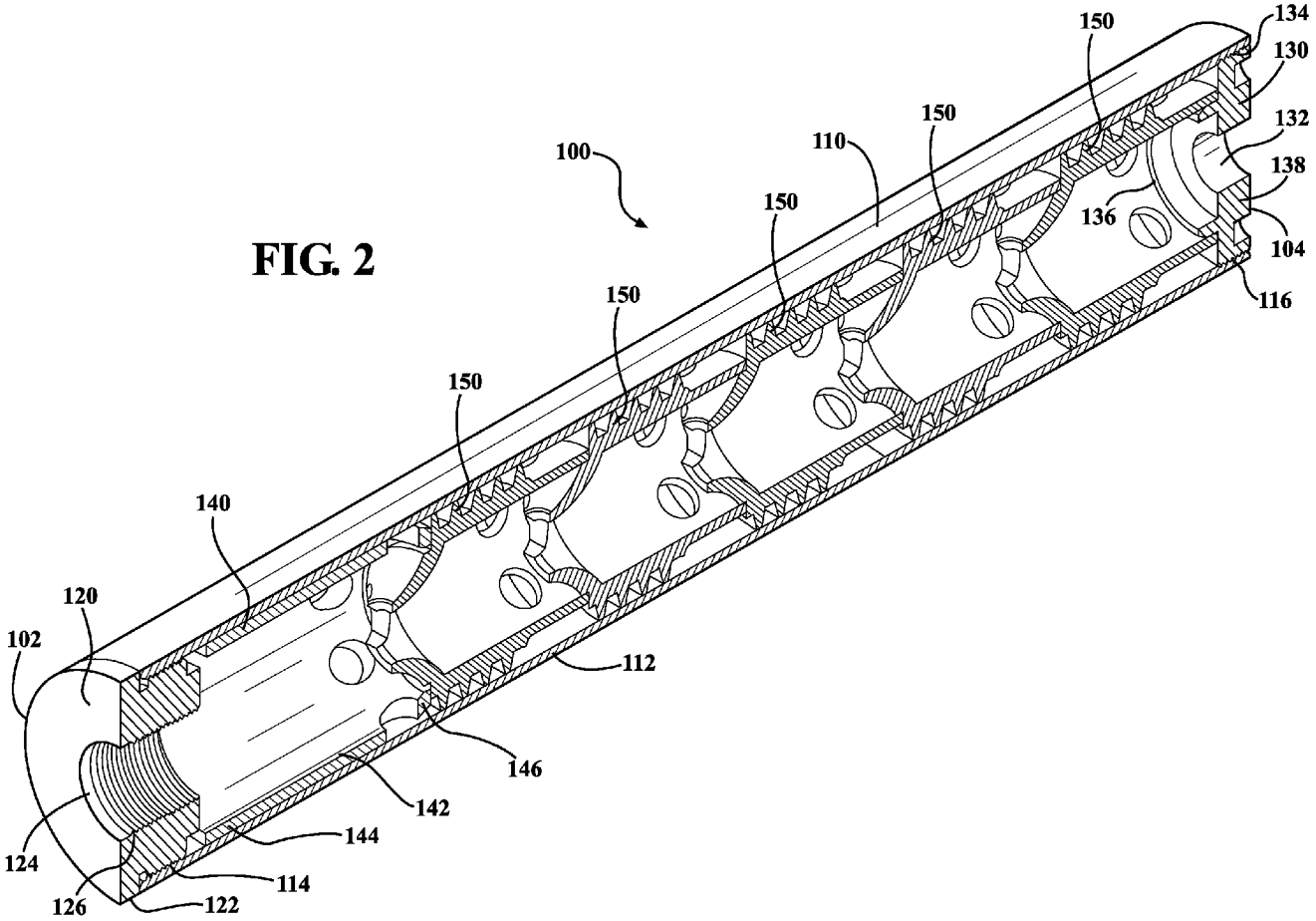
FIG. 2 is a cross-section perspective view showing the weapon silencer according to the first example.

FIGS. 1-2 show a weapon silencer 100 according to a first example. The weapon silencer 100 extends from a first end 102 to a second end 104. The first end 102 of the weapon silencer 100 can be connected to a weapon, such as a firearm, and may also be referred to herein as a muzzle end of the weapon silencer 100. The second end 104 of the weapon silencer 100 is axially opposite the first end 102, and may also be referred to herein as a discharge end of the weapon silencer 100.

The weapon silencer 100 includes a substantially cylindrical housing 110, a mounting adaptor 120, and end cap 130, a substantially cylindrical spacer 140, and a plurality of baffles 150. The mounting adaptor 120 is located at the first end 102 of the weapon silencer 100, and is connected to the cylindrical housing 110, such as by a threaded connection between the mounting adaptor 120 and the cylindrical housing 110. The end cap 130 is located at the second end 104 of the weapon silencer 100, and is connected to the housing 110, such as by a threaded connection between the housing 110 and the end cap 130. The spacer 140 is located inside the housing 110 near the first end 102 of the weapon silencer 100, and can be positioned between the mounting adaptor 120 and the baffles 150. The baffles 150 are positioned between the spacer 140 and the end cap 130. The baffles 150 are arranged in an axially adjacent configuration with respect to one another, along the longitudinal axis of the housing 110.

The housing 110 is a substantially cylindrical body in the form of a hollow tube. The housing 110 defines a cylindrical bore 112 that extends axially through the housing 110. Other components of the weapon silencer 100 can be disposed within the cylindrical bore 112 of the housing 110. For example, the spacer 140 and the baffles 150 can be disposed within the cylindrical bore 112 of the housing 110. The housing 110 can include a first threaded portion 114 at a first end thereof for threaded connection to the mounting adaptor 120. The housing 110 can also include a second threaded portion 116 at a second end thereof for threaded connection to the end cap 130. Alternatively, other structures could be provided for securing the cylindrical housing 110 to the mounting adaptor 120 and the end cap 130, such as fasteners of any conventional type.

The mounting adaptor 120 is connected to the housing 110 and is adapted to be connected to the discharge end or muzzle end of a firearm. Accordingly, when a firearm is connected to the weapon silencer 100 and is fired, the projectile that is discharged from the firearm enters the weapon silencer 100 at the mounting adaptor 120.

The mounting adaptor 120 can include a radially extending end wall 122 that has an outside diameter that is substantially equal to or greater than the outside diameter of the housing 110. The radially extending wall can define a substantially circular out of periphery for the mounting adaptor 120. Furthermore, the mounting adaptor 120 can be a substantially annular body with a bore 124 that extends along its longitudinal axis. The bore 124 can be sized such that it is configured to receive the muzzle of a firearm therein. The mounting adaptor 120 includes a mounting structure for securing the weapon silencer 100 to a firearm. In the illustrated example, a threaded portion 126 is formed within the bore 124 of the mounting adaptor 120. The threaded portion 126 is threadedly engageable with the muzzle of a firearm, which can be complimentarily threaded for connection to the mounting adaptor 120.

The bore 124 of the mounting adaptor 120 extends at least in part through a reduced diameter section 128 that, when assembled, is located within the housing 110. Along the exterior radial surface of the reduced diameter section 128, a threaded portion 129 is defined on the mounting adaptor 120 for threaded connection with the first threaded portion 114 of the housing 110.

The end cap 130 is an annular body having a central bore 132 that extends along a central axis of the end cap 130. A threaded portion 134 is formed on an outer radial surface of the end cap 130 for threaded connection with the second threaded portion 116 of the housing 110. An annular rim 136 extends inward from a main body portion 138 of the end cap 130 in the direction of the longitudinal axis of the end cap 130 and has radial surfaces that are spaced radially from the central bore 132 and the outer radial surface of the end cap 130, respectively.

The spacer 140 is a substantially cylindrical hollow body that is disposed within the housing 110 of the weapon silencer 100. The spacer 140 defines an axial bore 142 that extends coaxially with the cylindrical bore 112 of the housing 110 when the weapon silencer 100 is assembled. The spacer 140 has an outside diameter that is complimentary to the inside diameter of the cylindrical bore 112 of the housing 110, such that a close fit is defined between the housing 110 and the spacer 140. A first end 144 of the spacer abuts the mounting adaptor 120. A second end 146 of the spacer 140 abuts one of the baffles 150. Moreover, one of the baffles 150 can be at least partially received within the axial bore 142 of the spacer 140 adjacent to the second end 146 of the spacer 140. The spacer 140 tapers radially inward adjacent to the second end 146 thereof. A plurality of ports 148 extend radially through the annular wall of the spacer 140 in the tapered area to allow communication of gases from a firearm discharge to travel through the ports 148 and into an area that is defined between the spacer 140 and the housing 110 in the tapered area of the spacer 140 adjacent to the second end 146 thereof.

As previously noted, the weapon silencer 100 includes a plurality of baffles 150. In the illustrated embodiment, five baffles are included. However, it should be understood that the number of baffles provided can be increased or decreased depending upon the needs of a particular application.

Figure 3:
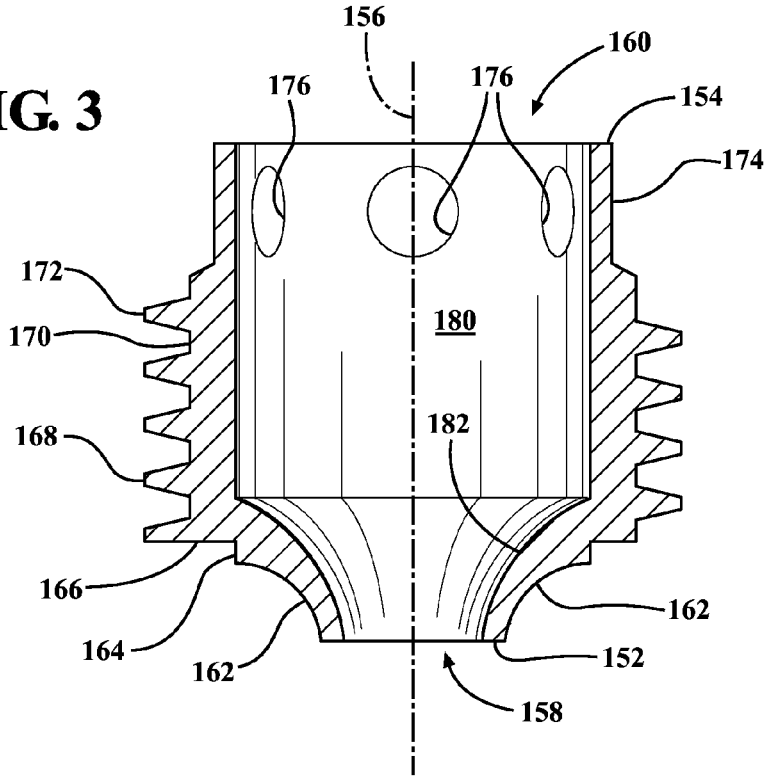
FIG. 3 is a cross section view showing a baffle from the weapon silencer according to the first example.

As best seen in FIG. 3, each of the baffles 150 is a substantially annular body that extends from a first end 152 to a second end 154 along a longitudinal axis 156. An inlet opening 158 is located at the first end 152 of each baffle 150. An outlet opening 160 is located at the second end 154 of each baffle 150.

Each of the baffles 150 includes a concave surface 162 that is located adjacent to the first end 152 of the baffle 150. The concave surface 162 is an exterior surface of the baffle 150 that extends circumferentially around the longitudinal axis 156 of the baffle 150. The concave surface 162 extends from the first end 152 until reaching a cylindrical shoulder 164. The cylindrical shoulder 164 is located on the exterior of the baffle 150, extends circumferentially around the longitudinal axis 156, and has an outside diameter that is complimentary to the inside diameter of the baffle 150 at the second end 154 thereof, and is also complimentary to the inside diameter of the spacer 140 at the second end 146 thereof. Accordingly, each of the baffles 150 can be inserted into the spacer 140 or into another one of the baffles 150 such that the concave surface 162 is disposed within the spacer 140 or the other baffle 150. To limit the depth of insertion of the baffle 150 into the spacer 140 or into another one of the baffles 150, a radially extending stop surface 166 is positioned on the exterior of the baffle 150 adjacent to the cylindrical shoulder 164, and extends substantially perpendicular to the longitudinal axis 156 of the baffle 150.

A spiraled vane 168 is formed on the exterior of the baffle 150, starting at the radially extending surface 166. The spiraled vane 168 can be formed integrally with the remainder of the baffle 150. For example, the entirety of the baffle 150 can be machined from a single metal blank. The spiraled vane 168 includes an inner periphery 170 of substantially constant diameter and an outer periphery 172 having a substantially constant diameter that is greater than the diameter of the inner periphery 170. The diameter of the outer periphery 172 of the spiraled vane 168 is complimentary to the inside diameter of the cylindrical bore of the housing 110, such that the baffles 150 are received within the housing 110 with a close fit between the cylindrical bore 112 and the outer periphery 172 of the spiraled vane 168, such that discharge gases from a firearm can be routed through the spiraled vane 168, and are thus directed around the baffle 150 several times before exiting the spiraled vane 168, instead of bypassing the spiraled vane 168 in the axial direction of the baffle 150. While the baffle 150 of the illustrated example includes a single spiraled vane 168, it should be understood that the baffle 150 could also be constructed with multiple adjacent spiraled vanes 168.

The spiraled vane 168 increases the length by which the discharge gases from a firearm travel, thus increasing the retention time of the gases in each baffle 150. This provides a greater length of time over which the discharge gases can cool. For example, the length of travel through the spiraled vane 168, in some examples, is five to seven times the axial length of the baffle. Also, by diverting the discharge gases through the spiraled vane 168, each baffle 150 avoids generation of excessive backpressure.

At the end of the spiraled vane 168, the baffles 150 each include a cylindrical wall 174 having a plurality of ports 176 that extend radially there through. The outside diameter of the cylindrical wall 174 is smaller than the diameter of the outer periphery 172 of the spiraled vane 168, and can also be smaller than the diameter of the inner periphery 170 of the spiraled vane 168. Thus, when the baffles 150 are disposed within the housing 110, a space is defined between the cylindrical wall 174 and the cylindrical bore 112 of the housing 110.

The interior of the baffles 150 each define an axial passageway 180 that extends from the inlet opening 158, which is also referred to herein as a first axial opening, to the outlet opening 160, which is also referred to herein as a second axial opening. In a first section of the axial passageway 180, a convex interior wall 182 is defined. The convex interior wall extends circumferentially around the longitudinal axis 156. In this section of the interior of the baffle 150, the diameter of the axial passageway increases from a smallest diameter adjacent to the first end 152 of the baffle 150 to a largest diameter at the end of the convex interior wall 182 in a direction of travel from the first end 152 toward the second end 154 along the longitudinal axis 156. In a second section of the axial passageway 180, which starts at the end of the convex interior wall 182, the diameter of the axial passageway 180 is constant. In this section, the spiraled vane 168 is formed on the exterior of the baffle 150. A third section of the axial passageway 180 is formed in the area where the ports 176 extend radially through the cylindrical wall 174 of the baffle 150. The diameter of the axial passageway 180 remains constant in this section. The ports 176 allow communication of gases from the axial passageway 180 to the space outside of the cylindrical wall 174 by the ports 176 during discharge of a firearm.

In operation, the weapon silencer 100 is mounted upon a firearm in order to silence the firearm during discharge. The weapon silencer 100 can be mounted to the firearm, for example, by threading the threaded portion 126 of the mounting adaptor 120 to a complimentary threaded portion on a muzzle of the firearm. This places the axial passage that extends through the weapon silencer 100 in registration with the muzzle of the firearm.

Upon discharge of the firearm, the bullet and the propelling gases rapidly move through the bore 124 of the mounting adaptor 120 and into the spacer 140. The greater diameter of the spacer 140 with respect to the bore 124 allows the gases to expand rapidly within the spacer 140, and a portion of the gases are directed radially through the ports 148 that are formed through the spacer 140 at the second end 146 thereof.

The gases that travel through the ports 148 of the spacer 140 are directed into the spiraled vane 168 of the baffle that is positioned adjacent to the spacer 140. These gases travel through the spiraled vane until reaching the second end of the baffle 150, where additional gases travel from the axial passageway 180 of the baffle 150, through the ports 176 that extend through the cylindrical wall 174 of the baffle 150, and join the gases that travel through the spiraled vane 168. With each successive baffle, additional gases enter the spiraled vane 168 of the respective baffle 150. In particular, since the gases that are traveling within the spiraled vanes 168 tend to decelerate and cool faster than the gases that travel through the axial passageway 180 of each of the baffles 150, the pressure within the axial passageway 180 of each baffle 150 is greater than the pressure that can be expected to be found outside the ports 176, in the space between the cylindrical wall 174 of the baffle 150 and the housing 110. Thus, a portion of the gas from the interior of the baffle 150 travels through the ports 176 and joins the gas that has been traveling through the spiraled vane 168. These gases combine and then enter the spiraled vane of the next baffle. When the gases reach the baffle 150 that is positioned adjacent to the end cap 130, the gases that travel through the spiraled vane 168 are forced into the axial passageway 180 through the ports 176, and exit the weapon silencer 100 through the bore 132 of the end cap 130.

Figure 6:
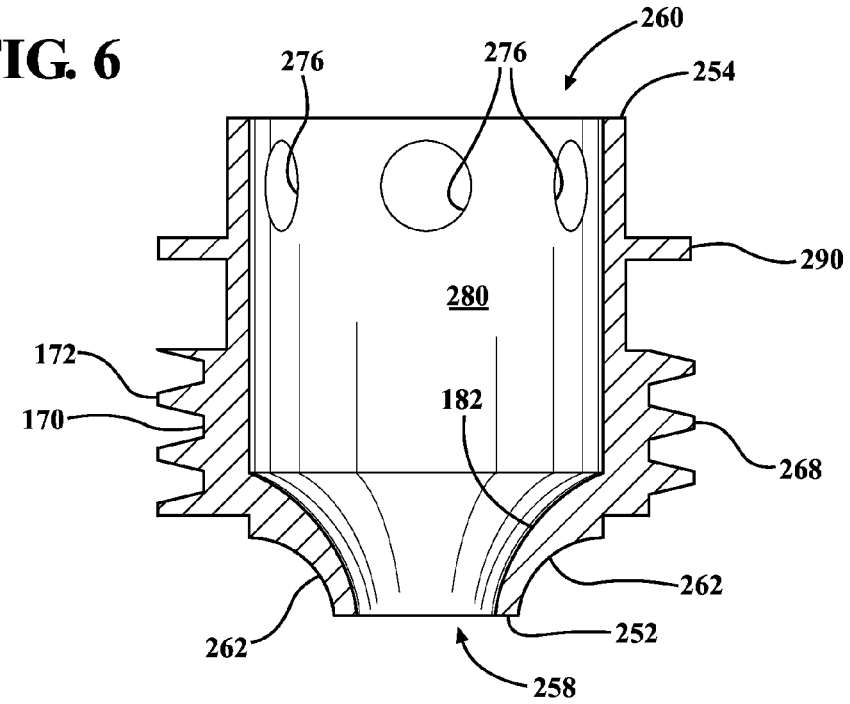
FIG. 6 is a cross section view showing a baffle from the weapon silencer according to the second example.
Figure 4:
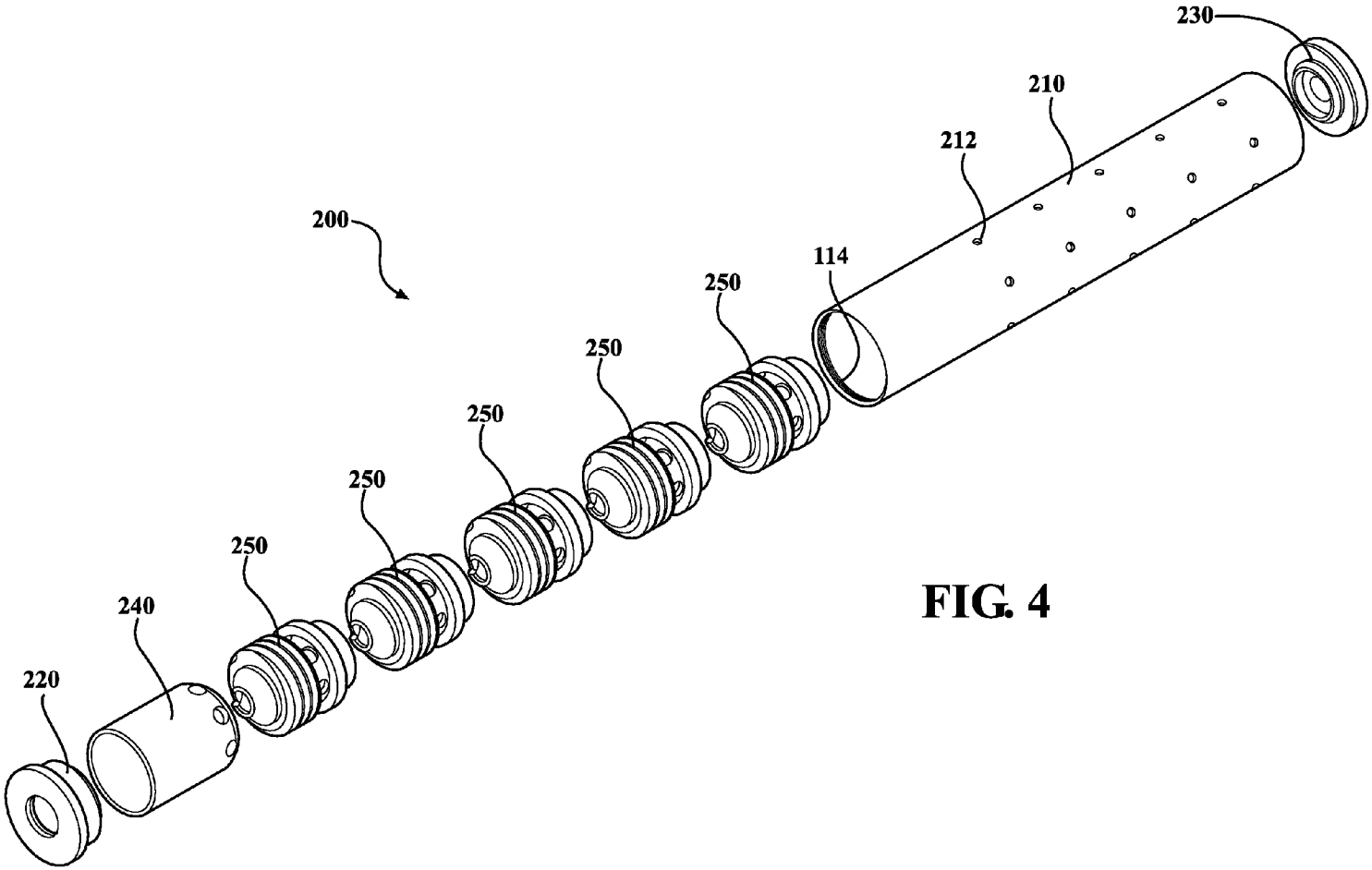
FIG. 4 is an exploded perspective view showing a weapon silencer according to a second example.
Figure 5:
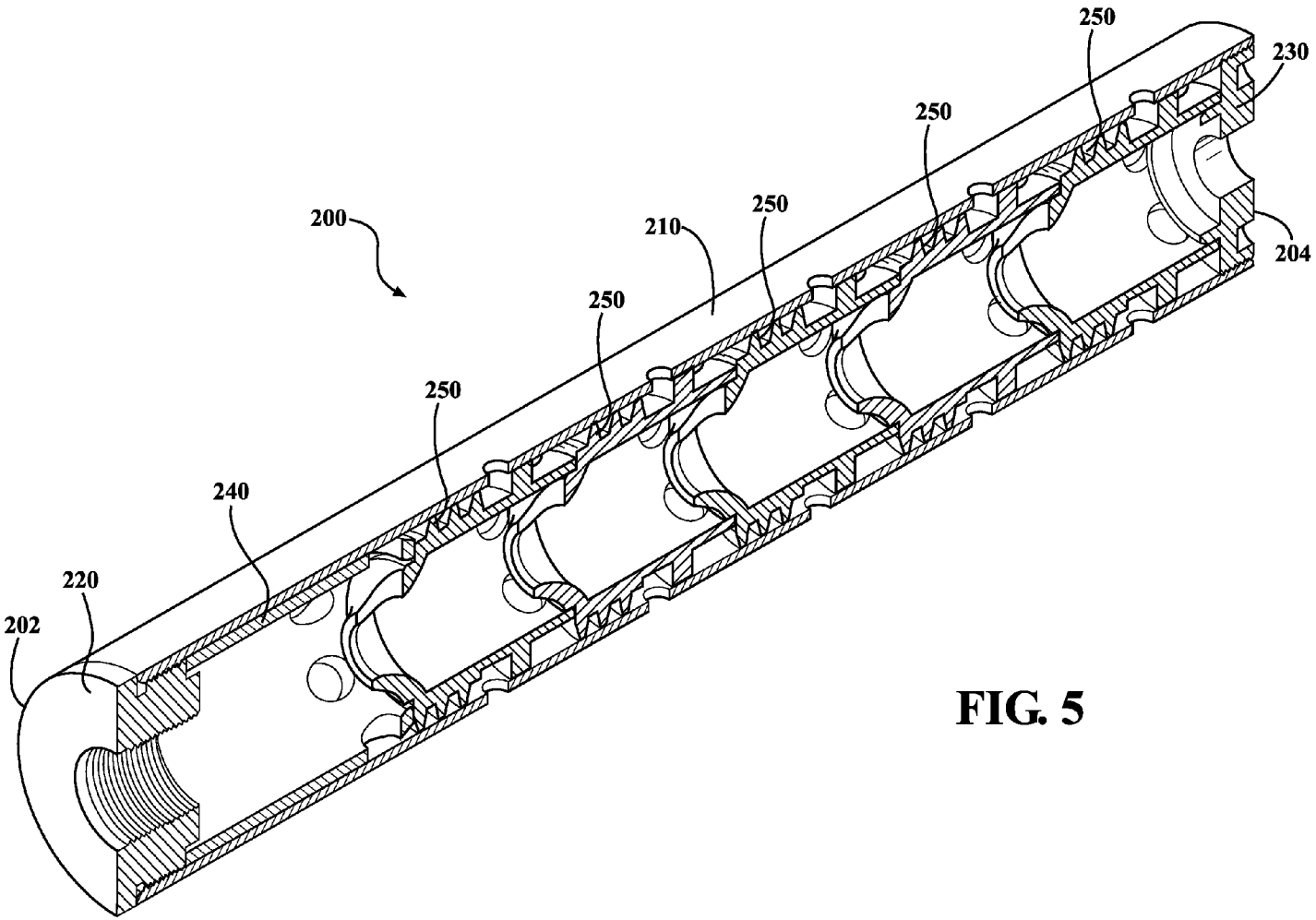
FIG. 5 is a cross-section perspective view showing the weapon silencer according to the second example.

FIGS. 4-6 show a weapon silencer 200 according to a second example. The weapon silencer 200 is identical in structure and operation to the weapon silencer 100, except as explicitly noted herein.

The housing 210 can include a plurality of ports 212 that are formed therethrough to allow gases to travel from the interior of the housing 210 to the exterior of the housing 210. This allows a portion of the discharged gases to be expelled from the weapon silencer 200 before reaching the end cap 230 thereof.

As best shown in FIG. 6, each of the baffles 250 includes a radially extending flange 290 that is positioned between a spiraled vane 268 and a second end 254 of the baffle 250. The radially extending flange 290 has a maximum outer diameter that is equal to the maximum outer diameter of the spiraled vane 268, which is formed on the baffle 250 and is substantially identical to the spiraled vane 168 of the baffle 150, as previously described. Because the outside diameter of the radially extending flange 290 and the spiraled vane 268 is complimentary to the inside diameter of the housing 210, gas is not permitted to travel axially passed the radially extending flange 290. Instead, the gas can be forced out of the cylindrical housing 210 through the ports 212. Thus, during discharge of a firearm that is connected to the weapon silencer 200, the portion of the gas that travels through the spiraled vane 268 is slowed down before being reaching the area between the spiraled vane 268 and the radially extending flange 290, where the gas travels out of the housing 210 through the ports 212, which are positioned adjacent to this area.

In order to allow discharge gases to enter the spiraled vane 268 of each of the baffles 250, the baffles 250 each have a plurality of ports 276 that extend radially through the cylindrical wall adjacent to the second end 254 between the radially extending flange 290 and the second end 254. Similar ports are provided in a substantially cylindrical spacer 240.

It should be understood that features of the weapon silencer 100 and features of the weapon silencer 200 can be combined. For example, the housing 110 of the weapon silencer 100 can be modified to include ports similar to the ports 212 of the housing 210 of the weapon silencer 200. Conversely, the housing 210 of the weapon silencer 200 can be eliminated. Other modifications and substitutions can also be made.

While the disclosure herein is made in connection with certain embodiments, it is to be understood that the claims are not to be limited to the disclosed embodiments but, on the contrary, are intended to cover various modifications and equivalent arrangements.

What is claimed is:

1. A baffle for a weapon silencer, comprising:

an annular wall that defines an axial passageway that extends from a first axial opening at a first axial end to a second axial opening at a second axial end;

the annular wall defining a first section located adjacent to the first axial end and in which a diameter of the axial passageway increases from a first diameter adjacent to the first axial end to a second diameter at a location that is spaced from the first axial end, wherein the first diameter is a smallest diameter of the axial passage and the second diameter is a largest diameter for the axial passage;

the annular wall defining a second section having a spiraled vane formed on an exterior surface of the annular wall, and the axial passageway having the second diameter throughout the second section; and the annular wall defining a third section that is located adjacent to the second axial end, the third section having a plurality of ports that extend radially through the annular wall to allow communication between the axial passageway and an exterior, and the axial passageway having the second diameter throughout the third section.

2. The baffle of claim 1, wherein the spiraled vane includes an inner periphery of a first substantially constant diameter and an outer periphery of a second substantially constant diameter that is greater than the first substantially constant diameter.

3. The baffle of claim 1, wherein the spiraled vane is formed integrally with the annular wall.

4. The baffle of claim 1, wherein the first section of the annular wall defines a convex interior surface.

5. The baffle of claim 1, wherein the first section of the annular wall defines a concave exterior surface.

6. The baffle of claim 1, wherein the axial passage has a substantially constant diameter in the second section of the annular wall and the third section of the annular wall.

7. The baffle of claim 1, wherein an outside diameter of the annular wall at the second axial end is smaller than an outside diameter of the spiraled vane.

8. The baffle of claim 1, further comprising:

an annular rim that extends outward from the annular wall between the spiraled vane and the second axial end of the baffle.

9. The baffle of claim 8, wherein the annular rim is substantially continuous.

10. The baffle of claim 9, wherein the annular rim has an outside diameter that is equal to a maximum outside diameter of the spiraled vane.

11. A weapon silencer, comprising:

a cylindrical housing that extends from a first end to a second end;

a mounting structure connected to the first end of the cylindrical housing, wherein the mounting structure is configured to connect the cylindrical housing to a weapon;

a cap connected to the second end of the cylindrical housing; and a plurality of axially adjacent annular baffles disposed within the cylindrical housing, each baffle having an annular wall that defines an axial passageway that extends from a first axial opening at a first axial end of the baffle to a second axial opening at a second axial end of the axial baffle, the annular wall defining a first section located adjacent to the first axial end of the baffle in which a diameter of the axial passageway increases from a smallest diameter adjacent to the first axial end of the baffle to a largest diameter at a location that is spaced from the first axial end of the baffle, the annular wall defining a second section having a spiraled vane formed on an exterior surface of the annular wall of the baffle, and the annular wall defining a third section that is located adjacent to the second axial end of the baffle, the third section having a plurality of ports that extend radially through the annular wall of the baffle to allow communication between the axial passageway and an exterior of the baffle.

12. The weapon silencer of claim 11, wherein the spiraled vane of each baffle includes an inner periphery of a first substantially constant diameter and an outer periphery of a second substantially constant diameter that is greater than the first substantially constant diameter.

13. The weapon silencer of claim 11, wherein the spiraled vane of each baffle is formed integrally with the annular wall.

14. The weapon silencer of claim 11, wherein the first section of the annular wall of each baffle defines a convex interior surface.

15. The weapon silencer of claim 11, wherein the first section of the annular wall of each baffle defines a concave exterior surface.

16. The weapon silencer of claim 11, wherein the axial passage of each baffle has a substantially continuous diameter in the second section of the annular wall and the third section of the annular wall.

17. The weapon silencer of claim 11, wherein an outside diameter of the annular wall of each baffle at the second axial end is smaller than an outside diameter of the spiraled vane.

18. The weapon silencer of claim 11, wherein each baffle includes an annular rim that extends outward from the annular wall between the spiraled vane and the second axial end of the baffle.

19. The weapon silencer of claim 18, wherein the cylindrical housing includes a plurality of ports and the annular rim of each baffle is substantially continuous such that at least a portion of gas that passes through the spiraled vanes is forced through the ports through the cylindrical housing to the exterior of the cylindrical housing.

20. The weapon silencer of claim 19, wherein the annular rim of each baffle has an outside diameter that is equal to a maximum outside diameter of the spiraled vane.

* * * * *